US006269492B2

(12) United States Patent
Miyoshi et al.

(10) Patent No.: US 6,269,492 B2
(45) **Date of Patent: *Aug. 7, 2001**

(54) AUTOMATIC HAIR WASHER

(75) Inventors: Hideaki Miyoshi; Hirohisa Shimizu, both of Osaka (JP)

(73) Assignee: Oohiro Works, Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/476,185

(22) Filed: Jan. 3, 2000

(30) Foreign Application Priority Data

Feb. 26, 1999 (JP) ..... 11-51756

(51) Int. Cl.[7] ..... A45D 19/00
(52) U.S. Cl. ..... 4/515; 4/517; 4/601; 4/603
(58) Field of Search ..... 4/515, 516, 517, 4/518, 519, 598, 602, 601, 618, 603, 597, 605

(56) References Cited

U.S. PATENT DOCUMENTS 3,521,647 * 7/1970 Mercer ..... 4/515
3,732,580 * 5/1973 Fava ..... 4/515

FOREIGN PATENT DOCUMENTS

2134121 * 5/1990 (JP) .
7-75567 8/1996 (JP) .
928447 * 7/1997 (JP) .

* cited by examiner

*Primary Examiner*—Greogory L. Huson
*Assistant Examiner*—Khoa Huynh
(74) *Attorney, Agent, or Firm*—Burr & Brown

(57) ABSTRACT

An automatic hair washer which has plural washing nozzles for spouting wash water to a head part, and includes a hot water storing tank for storing wash water, a hot water supplying pump for pumping wash water from the hot water storing tank and supplying the pumped wash water to the washing nozzles. Hot water supplying electromagnetic valves for controlling spouting of wash water from the washing nozzles by opening/closing operations thereof are also provided along with hot water supplying pump control for controlling output from the hot water supplying pump to change amounts of wash water supplied to the washing nozzles from the hot water supplying pump in correlation with the opening/closing operations of the hot water supplying electromagnetic valves.

1 Claim, 7 Drawing Sheets

AUTOMATIC HAIR WASHER

FIELD OF THE INVENTION

The present invention relates to an automatic hair washer which is installed in a beauty salon, a barbershop or the like.

BACKGROUND OF THE INVENTION

FIG. 3 is a diagram illustrating a structure of a prior art automatic hair washer.

In the figure, reference numeral 1 denotes a mixing tank for mixing water and hot water which is transmitted from an external water supply and an external hot water supply, via a curb stop, a strainer, and a check valve (which are not shown), to prepare wash water having a temperature suitable for hair washing. Numeral 2 denotes a motor valve. Numeral 3 denotes a hot water storing tank for storing the wash water supplied from the mixing tank 1 via the motor valve 2. Numeral 4 denotes a thermistor provided at a lower position in the hot water storing tank 3 to measure a temperature of the wash water in the hot water storing tank 3. Numeral 5 denotes a float switch for detecting an amount of the wash water in the hot water storing tank 3. Numeral 6 denotes a hot water supplying pump for pumping out wash water from the hot water storing tank 3. Numeral 7 denotes a valve for hand shower. Numeral 8 denotes a drawable hand shower used for washing off hairs, shampoo agent, or conditioner agent which are attached to a cistern, or in finishing hair washing. Character A1 denotes a hot water supply pipe, one end of which is connected to the hot water supplying pump 6, to lead the wash water pumped out by the hot water supplying pump 6. Numeral 9 denotes a draining electromagnetic valve provided in midway in the hot water supply pipe A1 to drain unnecessary wash water. Characters S1 to S12 denote shower heads, each being connected to an end of the branched hot water supply pipe A1, to spout wash water. Numerals 10*a* to 10*k* denote hot water supplying electromagnetic valves for supplying the wash water to the shower heads S1 to S12 and nozzle heads N1 to N6 by opening operations, and stopping the supply of the wash water by closing operations. Numeral 11 denotes a shampoo tank for storing shampoo agent. Numeral 12 denotes a conditioner tank for storing conditioner agent. Numeral 13 denotes a shampoo supplying pump for pumping out shampoo agent from the shampoo tank 11. Numeral 14 denotes a conditioner supplying pump for pumping out conditioner agent from the conditioner tank 12. Numerals 15 and 16 denote check valves. Characters N1 to N6 denote the nozzle heads, each being connected to an end of the branched hot water supply pipe A1, to spout the wash water mixed with the shampoo agent or the conditioner agent which is pumped out from the shampoo tank 11 or the conditioner tank 12. Numeral 20 denotes a hot water supplying pump control unit for controlling the output of the hot water supplying pump 6 to change amounts of the wash water supplied to the shower heads S1 to S12 and the nozzle heads N1 to N6.

FIGS. 4 to 6 are diagrams schematically illustrating a structure of the cistern of the prior art automatic hair washer. FIG. 4 is a plan view, FIG. 5 is a longitudinal sectional view taken in the direction of the arrows along a line V—V of FIG. 4, and FIG. 6 is a longitudinal sectional view taken in the direction of the arrows along a line V1—V1 of FIG. 4.

In the figures, the same reference numerals and characters as those in FIG. 3 denote the same or corresponding parts. Numeral 31 denotes a cistern into which a person 35 whose hair is to be washed inserts his head. Numeral 32 denotes a cabinet. Numeral 33 denotes a neck receiving part for supporting the nape part of the person under hair washing 35 when the person inserts his head toward the cistern 31. Numeral 34 denotes a drain outlet.

As shown in the figures, the shower heads S1 to S12 and the nozzle heads N1 to N6 are provided on inner walls of the cistern 31, and hair washing is performed using wash water spouted from these washing nozzles. Respective washing nozzles spout the wash water toward different parts. The shower heads S1 and S12 wash the top of the head, the shower heads S2 to S5 wash the sides, the shower heads S6 and S11 wash the back, and the shower heads S7 to S10 wash the nape, respectively.

FIG. 7 is a timing chart for illustrating the opening/closing operation of the hot water supplying electromagnetic valves 10*a* to 10*k* for the shower heads S1 to S12 and the nozzle heads N1 to N6, and the output from the hot water supplying pump 6, in the prior art automatic hair washer.

Hereinafter, an operation of the prior art automatic hair washer will be described with reference to FIG. 7.

First, in an initial drainage step to, cooled wash water remaining in the hot water supply pipe A1 is spouted from the shower heads S1 to S12 and the nozzle heads N1 to N6, via the hot water supplying electromagnetic valves 10*a* to 10*k*.

Next, the operation proceeds to a preliminary washing step t1, and the wash water is spouted over all the hair from the shower heads S1 to S12 in a prescribed order, with the wash water from the shower heads overlapping each other.

Then, the operation proceeds to a shampooing step t2, and wash water is spouted from the shower heads S1 to S12, as well as wash water mixed with shampoo agent pumped by the shampoo supplying pump 13 is spouted from the nozzle heads N1 to N6.

When the shampooing step t2 is finished, the operation proceeds to an osmosis step t3, a secondary washing step t4, a massage step t5, a conditioning step t6, and a rinsing step t7, and thus, the series of washing steps are completed.

As shown in FIG. 7, outputs from the hot water supplying pump 6 are decided in advance for the respective steps. For example, in the massage step, in order to stimulate the head, the output from the hot water supplying pump 6 and the pressure of the wash water spouted from the shower heads S1 to S12 are relatively high. In the conditioning step, it is not necessary that the conditioner agent reaches the head like the shampoo agent. It is sufficient for the conditioner agent to be applied to the hair. Therefore, the output from the hot water supplying pump 6 is set lower and pressures of the wash water spouted from the shower heads S1 to S12 and the nozzle heads N1 to N6 are relatively low. As described above, the outputs from hot water supplying pump 6 are changed for the respective washing steps, whereby the forces of the wash water spouted from the washing nozzles are varied.

However, when hair is washed using the prior art automatic hair washer, the output from the hot water supplying pump is kept constant for each step and the same amount of the wash water is supplied to each washing nozzle. Therefore, the amount and hydraulic pressure of the wash water spouted over the head from each washing nozzle are fixed in the prior art automatic hair washer, although the amount and pressure of the wash water is varied depending upon the part of the hair to be washed. For example, tip parts of hair are easily cleaned with a small amount of wash water, but the scalp is difficult to clean and requires massaging by forcibly scattering wash water to it. Accordingly, excessive wash water is spouted to parts where a large amount of wash water is not necessary, and thus it is uneconomical and inefficient.

Further, the head has parts which are insensitive to stimuli, such as the top of the head, or sensitive parts such as the nape part. Therefore, even if the wash water is spouted under a constant pressure, the person under hair washing feels a pain in some parts, or feels dissatisfied with the stimuli in other parts.

SUMMARY OF THE INVENTION

The present invention is made to solve the above-described problems, and it is an object of the present invention to provide an automatic hair washer which can wash hair in a most suitable situation for parts which are washed by respective washing nozzles and purposes of the washing nozzles.

According to a first aspect of the present invention, an automatic hair washer which has a plurality of washing nozzles for spouting wash water to a head part, comprises: a hot water storing tank for storing the wash water; a hot water supplying pump for pumping the wash water from the hot water storing tank and supplying the pumped wash water to the washing nozzles; hot water supplying electromagnetic valves for controlling spouting of the wash water from the washing nozzles by opening/closing operations thereof; and hot water supplying pump control means for controlling output from the hot water supplying pump to change amounts of the wash water supplied to the washing nozzles from the hot water supplying pump, in timings of the opening/closing operations of the hot water supplying electromagnetic valves. Therefore, hair washing can be performed under pressures and with amounts of the wash water spouted from respective washing nozzles, which are most suitable for respective parts washed by the washing nozzles, purposes or configurations of the washing nozzles, whereby hair washing is performed more economically and efficiently without wasting wash water. In addition, the pressures of wash water spouted from the respective washing nozzles are varied, thereby increasing the massage effects for the head. Further, the spouting pressure of the wash water is adjusted according to the sensitivity of the parts washed by the respective washing nozzles, resulting in more comfortable hair washing.

DETAILED DESCRIPTION OF THE PREFERRED EMBODIMENTS

Embodiment 1.

Figure 1:
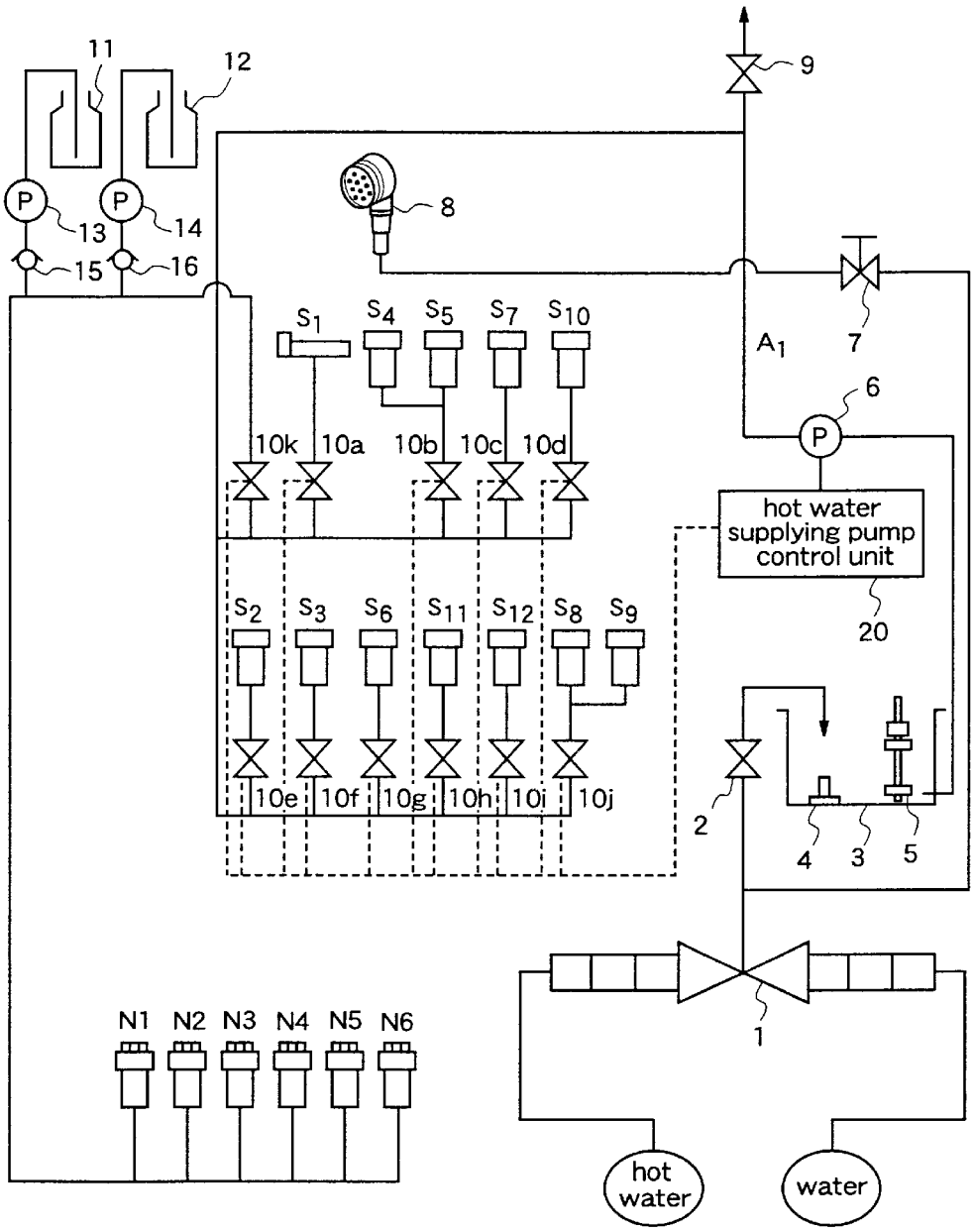
FIG. 1 is a diagram illustrating a structure of an automatic hair washer according to a first embodiment of the present invention.

FIG. 1 is a diagram illustrating a structure of an automatic hair washer according to the first embodiment of the present invention.

Figure 3:
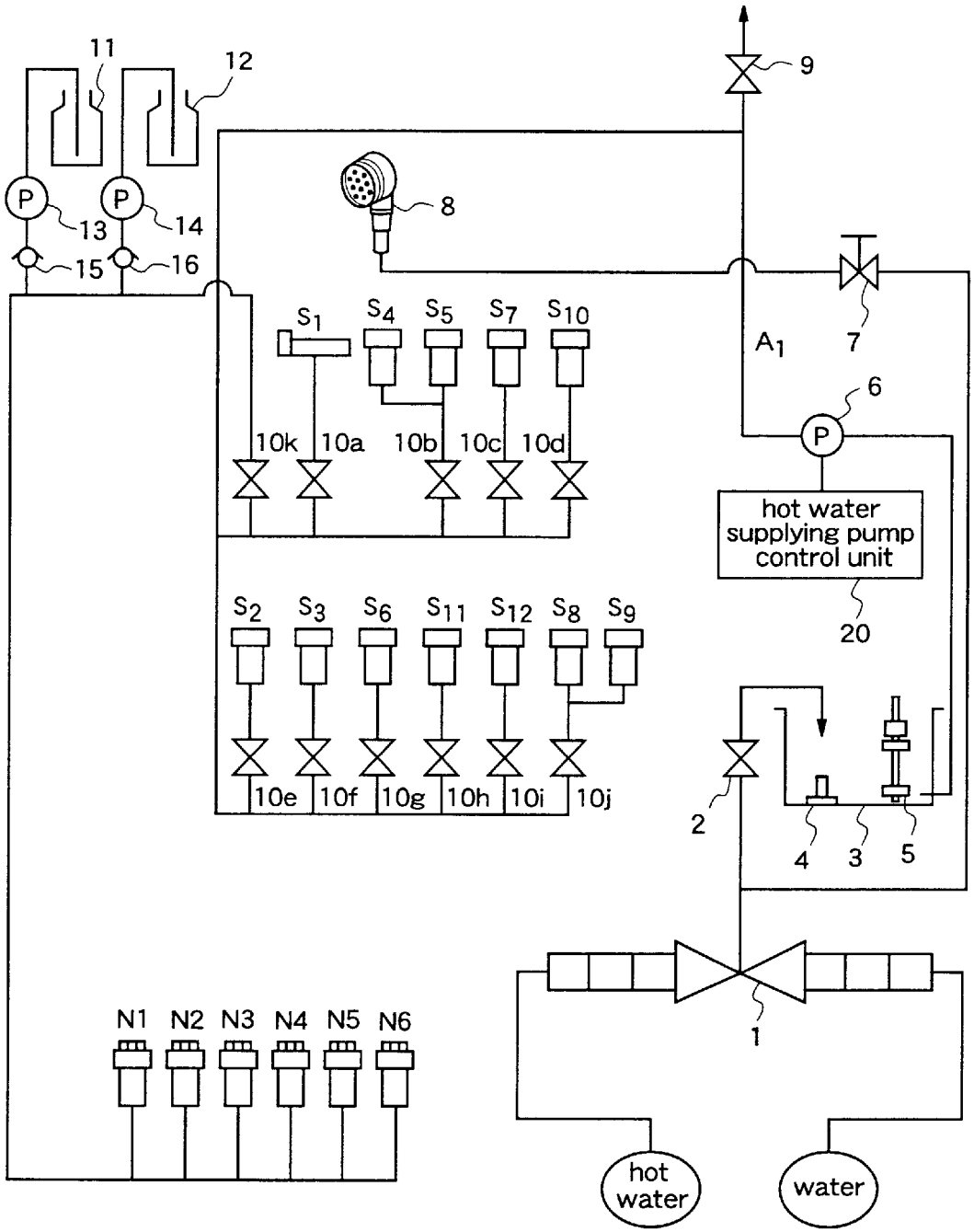
Fig. 3 Prior Art
FIG. 3 is a diagram illustrating a structure of a prior art automatic hair washer.
Figure 4:
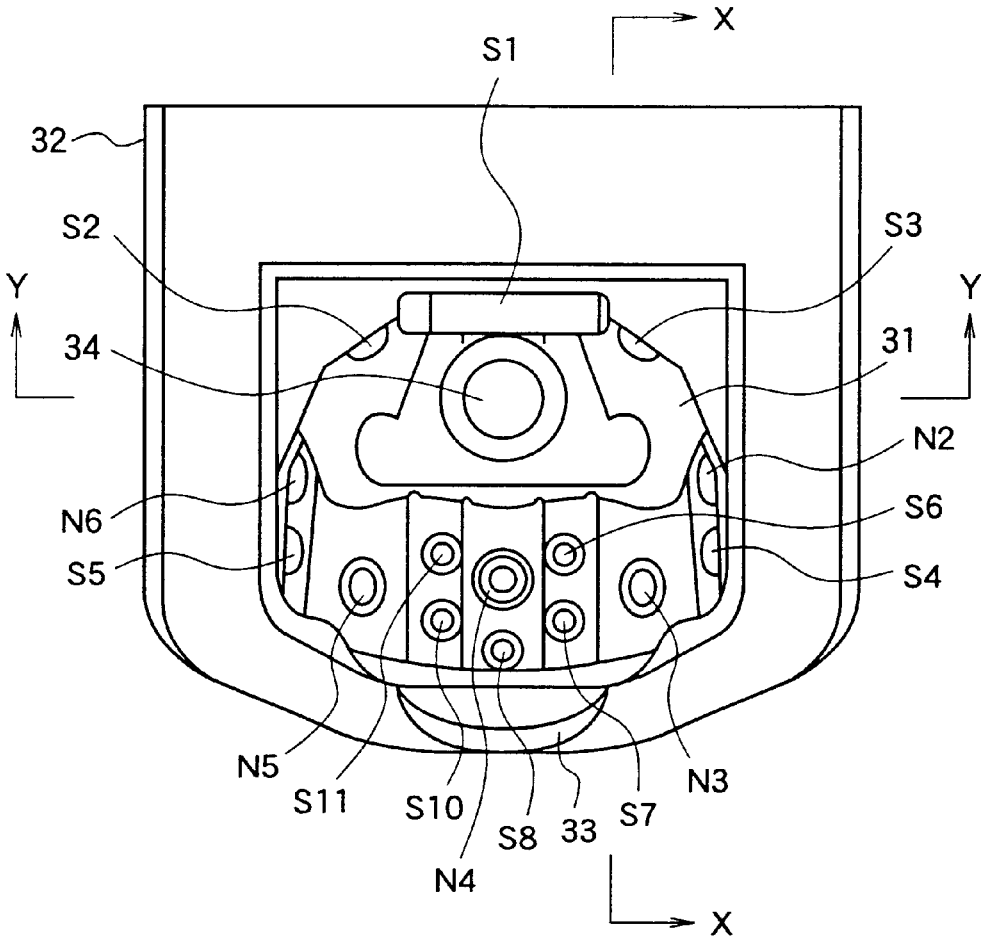
Fig. 4 Prior Art
FIG. 4 is a plan view schematically illustrating a structure of a cistern of the prior art automatic hair washer.
Figure 5:
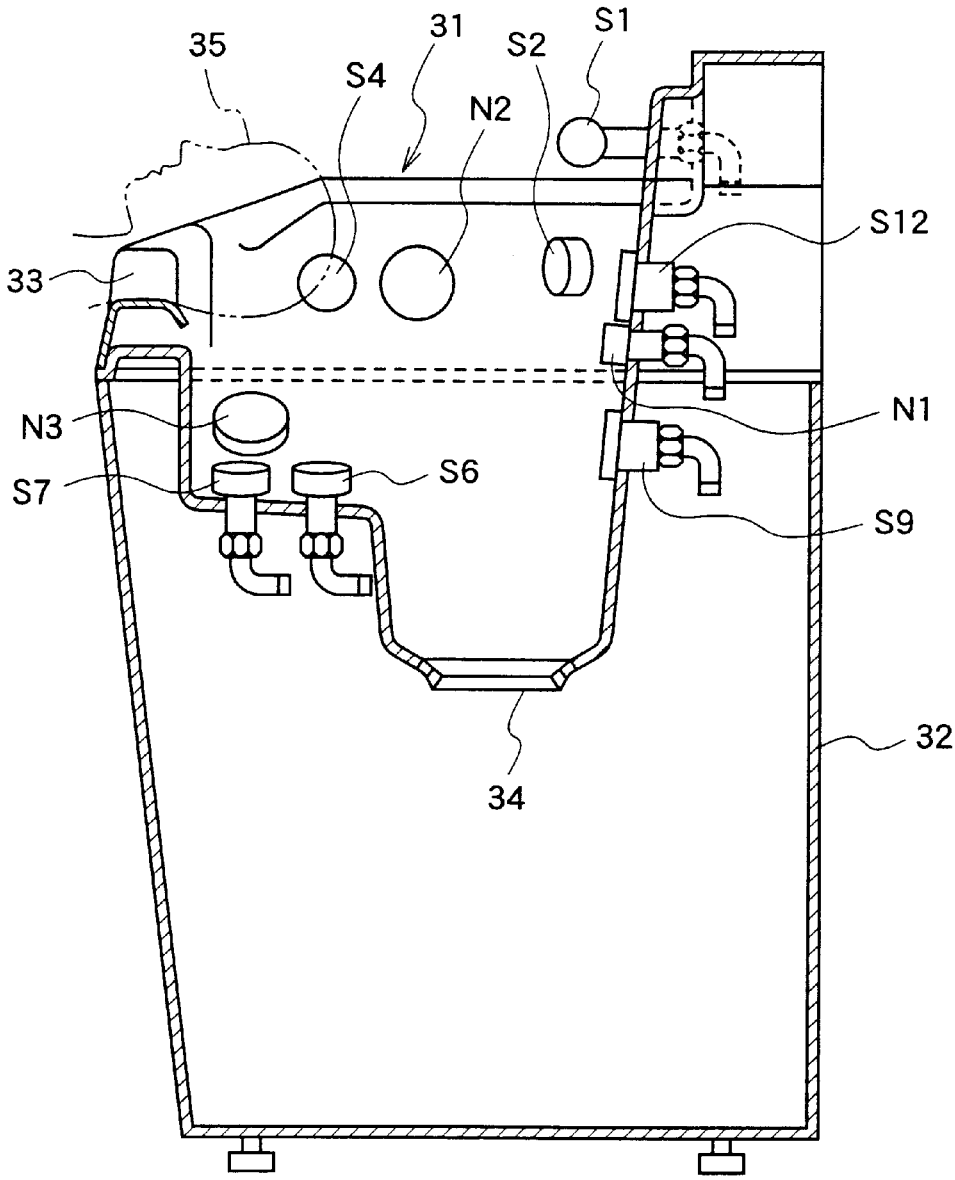
Fig.5 Prior Art
FIG. 5 is a longitudinal sectional view of the automatic hair washer of FIG. 4, taken in the direction of the arrows along a line V—V.
Figure 6:
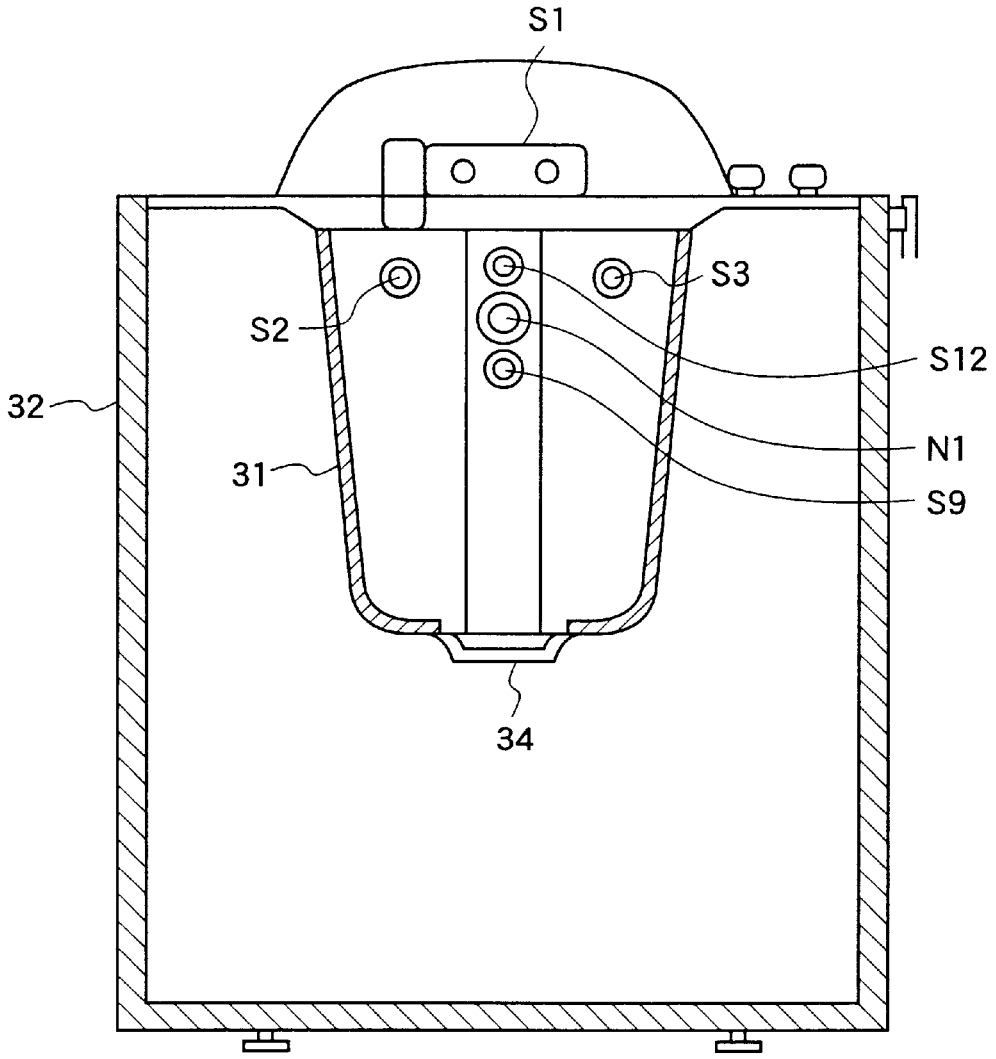
Fig. 6 Prior Art
FIG. 6 is a longitudinal sectional view of the automatic hair washer of FIG. 4, taken in the direction of the arrows along a line V1—V1.
Figure 7:
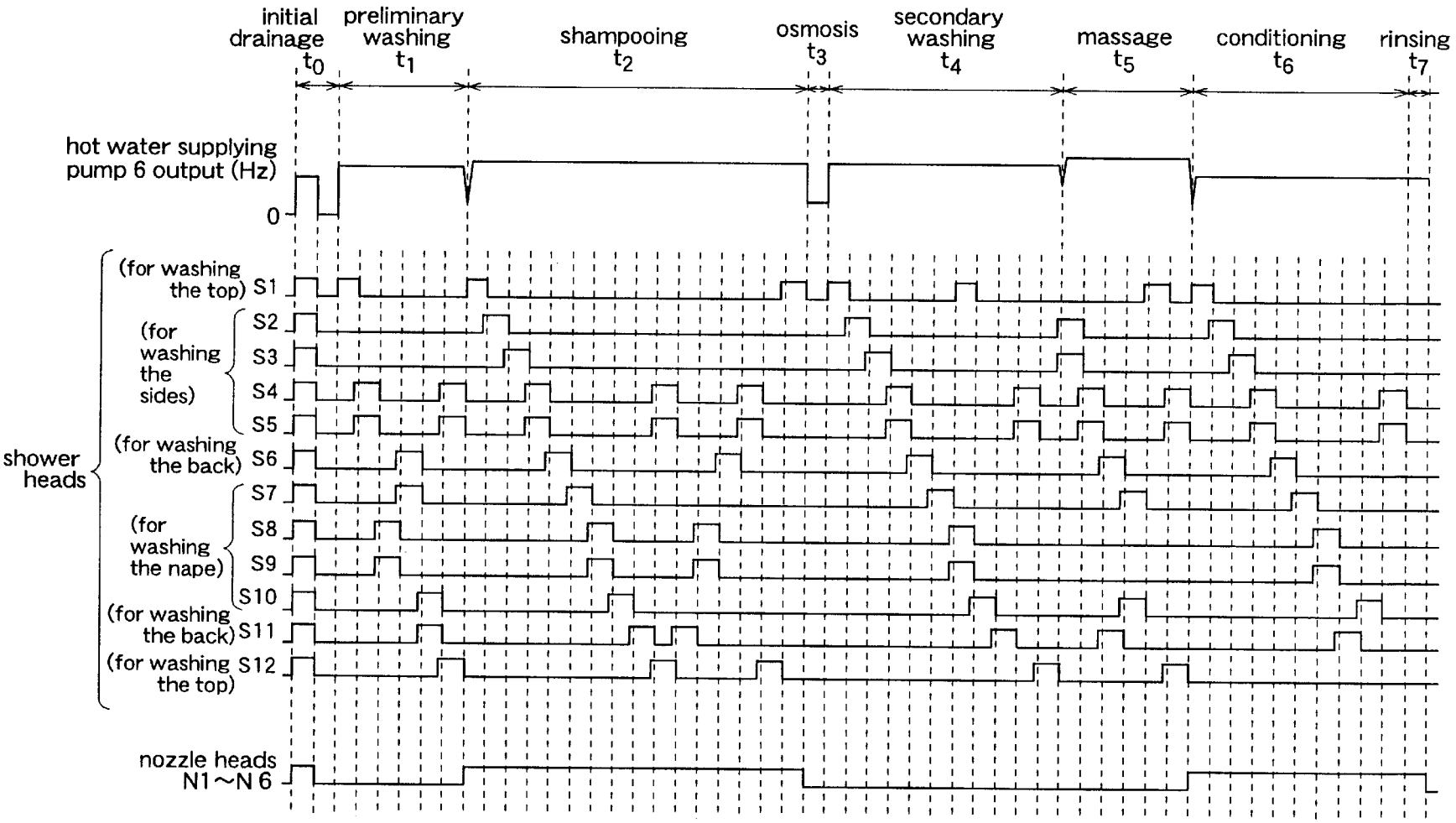
Fig. 7 Prior Art
FIG. 7 is a timing chart for showing opening/closing operations of hot water supplying electromagnetic valves for shower heads and nozzle heads, and output from a hot water supplying pump, in the prior art automatic hair washer.

In the figure, the same reference numerals and characters as those in FIG. 3 denote the same or corresponding parts. The hot water supplying pump control unit 20 controls output from the hot water supplying pump 6 and determines when the hot water supplying electromagnetic valves 10*a* to 10*j* for the shower heads S1 to S12 perform opening and closing operations, to change amounts of the wash water supplied to the shower heads S1 to S12.

Figure 2:
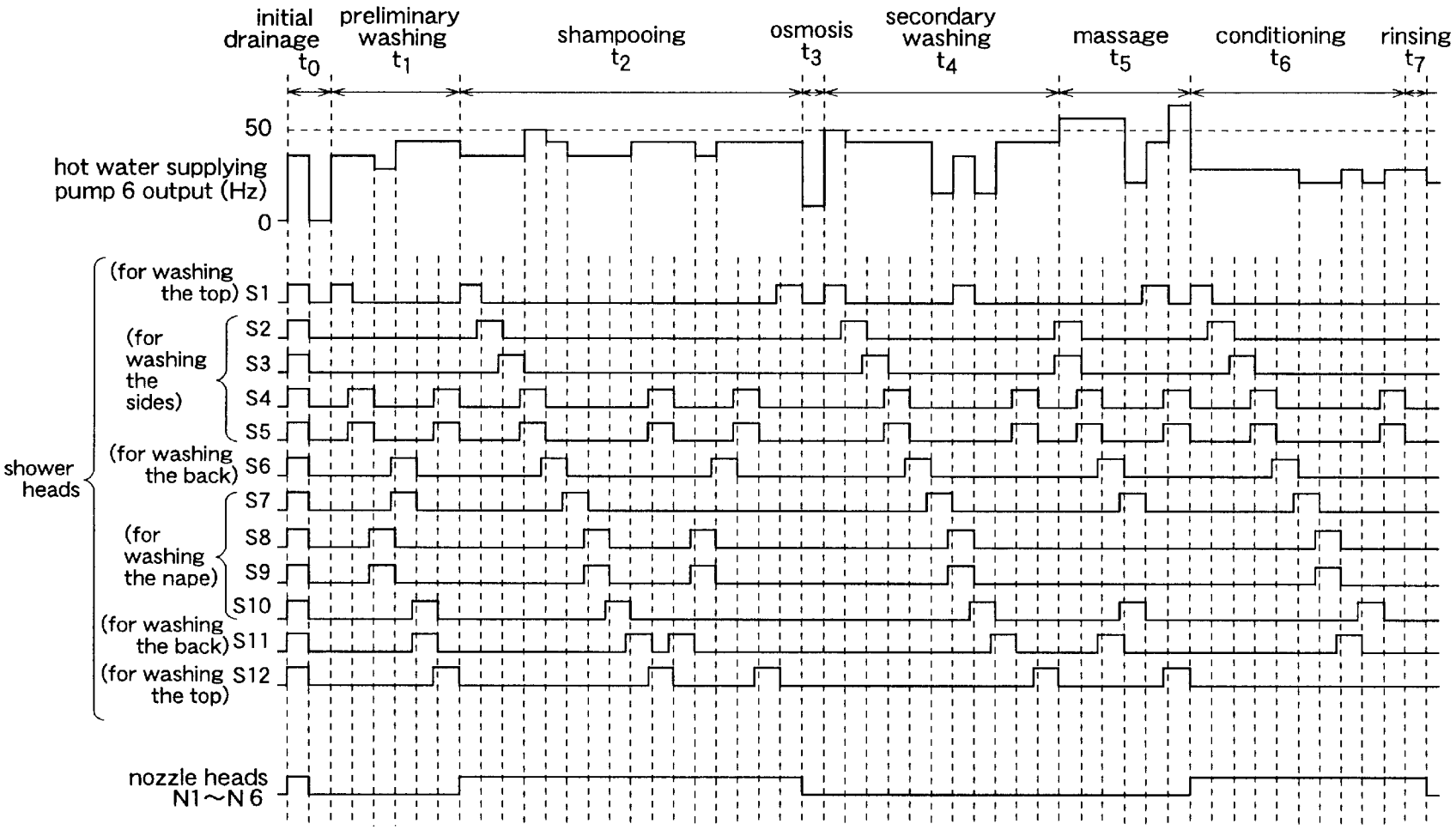
FIG. 2 is a timing chart for showing opening/closing operations of hot water supplying electromagnetic valves for shower heads and nozzle heads, and output from a hot water supplying pump, in the automatic hair washer of the first embodiment.

FIG. 2 is a timing chart for showing opening/closing operations of the hot water supplying electromagnetic valves 10*a* to 10*k* for the shower heads S1 to S12 and nozzle heads N1 to N6, and output from the hot water supplying pump 6, in the automatic hair washer according to the first embodiment.

Hereinafter, an operation of the automatic hair washer of the first embodiment will be described with reference to FIG. 2.

First, in an initial drainage step to, cooled wash water remaining in the hot water supply pipe A1 is spouted from the shower heads S1 to S12 and the nozzle heads N1 to N6, via the hot water supplying electromagnetic valves 10*a* to 10*k*.

Next, the operation proceeds to the preliminary washing step t1, and the wash water is spouted over the hair from shower heads S1 to S12 in a prescribed order, with the wash water from the shower heads overlapping each other.

Then, the operation proceeds to the shampooing step t2, and wash water is spouted from shower heads S1 to S12 via the hot water supplying electromagnetic valves 10*a* to 10*j*, as well as wash water mixed with shampoo agent pumped by the shampoo supplying pump 13 being spouted from the nozzle heads N1 to N6 via the hot water supplying electromagnetic valve 10*k*.

When the shampooing step t2 is finished, the operation proceeds to an osmosis step t3, a secondary washing step t4, a massage step t5, a conditioning step t6, and a rinsing step t7, and thus, the series of washing steps is completed.

As shown in FIG. 2, in all of the washing steps from the preliminary washing step t1 to the rinsing step t7, the output from the hot water supplying pump 6 is changed by the hot water supplying pump control unit 20, by timing the opening/closing operations of the hot water supplying electromagnetic valves 10*a* to 10*j* for the shower heads S1 to S12, to change amounts of the wash water supplied to the showerheads S1 to S12, thereby changing the amounts and the pressures of the wash water spouted from the shower heads S1 to S12.

For example, in order not to spout wash water abruptly to the nape part in the all washing steps, when the electromagnetic valves c, d, and j for the shower heads S7 to S10 spouting wash water to the nape part are opened, the output of the hot water supplying pump 6 is lowered by the hot water supplying pump control unit 20, to lower the pressure of the wash water spouted from the shower heads S7 to S10.

More specifically, in the secondary washing step t4, respective parts are washed with wash water spouted from the shower heads S1 to S10, from the top of the head, the sides, the back, and the nape part in that order. While the top, the sides, and the back of the head are washed, the output from the hot water supplying pump 6 is about 50 Hz. And then, when the nape part is washed, that is, when the electromagnetic valve c for the shower head S7 is opened, the output of the hot water supplying pump 6 is quickly reduced, whereby the wash water is not spouted abruptly to the nape part from the shower heads S7 to S10.

In addition, the output from the hot water supplying pump 6 is changed by the hot water supplying pump control unit 20 by timing when the hot water supplying electromagnetic valves 10*a* to 10*j* for the shower heads S1 to S12 are opened or closed to change the amounts and the pressures of wash water spouted from the shower heads S1 to S12. Therefore, hair washing can be performed under the pressures and with the amounts of wash water which are most suitable for dirt levels of respective parts washed by the shower heads S1 to S12.

Further, the pressures of the wash water spouted from the shower heads S1 to S12 are varied, so that the stimuli given to the head by the wash water does not become monotonous and the massage effects for the head are increased.

Here, when nozzles have different configurations, such as the shower heads S1 to S12 having plural watering holes and spouting wash water like a shower, or the nozzle heads N1 to N6 having one watering hole and spouting wash water like a mist, even if the same amounts of wash water are supplied to the respective washing nozzles, the manner of wash water spouted from the respective nozzles, or the force or amount of wash water emitted, varies slightly with the different nozzles. Therefore, the amount of wash water supplied from the hot water supplying pump 6 can be changed slightly, according to the configuration or the like of the respective washing nozzles.

As described above, according to the first embodiment, the output from the hot water supplying pump 6 is changed by the hot water supplying pump control unit 20 by timing the opening/closing operations of the hot water supplying electromagnetic valves 10*a* to 10*j* for the shower heads S1 to S12, to vary the pressures or amounts of the wash water spouted from the shower heads S1 to S12. Therefore, it is possible to wash hair under the pressures and with the amounts of wash water, which are most suitable for hair washing in respective parts washed by the shower heads S1 to S12, thereby performing hair washing more economically and efficiently without wasting the wash water. In addition, the pressures of the wash water spouted from the shower heads S1 to S12 are varied, thereby increasing the massage effects for the head. Further, the pressure of the spouted wash water is adjusted according to the sensitivity of parts washed by the shower heads S1 to S12, thereby providing more comfortable hair washing.

What is claimed is:

1. An automatic hair washer which has plural washing nozzles at fixed locations within a basin for spouting wash water to a head part, comprising:

a hot water storing tank for storing wash water;

a hot water supplying pump for pumping wash water from the hot water storing tank and supplying the pumped wash water to the washing nozzles;

hot water supplying electromagnetic valves provided for the respective washing nozzles for controlling spouting of wash water from the washing nozzles by opening/closing operations thereof; and hot water supplying pump control means for controlling output from the hot water supplying pump to change amounts of wash water supplied to the washing nozzles from the hot water supplying pump, in correlation with the opening/closing operations of the hot water supplying electromagnetic valves, wherein a single operating cycle of said hair washer includes a plurality of stages, and in each single stage of hair washing, the hot water supplying electromagnetic valves are opened/closed so that wash water flows from at least one nozzle of said washing nozzles for a predetermined period and then wash water flows from said at least one nozzle and another nozzle in an overlapping manner by opening the electromagnetic valve of said another nozzle while wash water is flowing out from said at least one nozzle, and wherein said hot water supplying pump control means changes pressures and amounts of wash water supplied to the washing nozzles in accordance with the fixed location of said washing nozzles within said basin and each stage of hair washing.

* * * * *